United States Patent [19]

Scott

[11] Patent Number: 4,918,773

[45] Date of Patent: Apr. 24, 1990

[54] POSTURIZED SPRING BEDDING PRODUCT

[75] Inventor: Terence A. Scott, Carthage, Mo.

[73] Assignee: Leggett & Platt, Incorporated, Carthage, Mo.

[21] Appl. No.: 285,778

[22] Filed: Dec. 16, 1988

[51] Int. Cl.[5] ..... A47C 27/07

[52] U.S. Cl. ..... 5/252; 5/268; 5/464; 5/475

[58] Field of Search ..... 5/252, 253, 261, 268, 5/447, 464, 475; 267/63, 105

[56] References Cited

U.S. PATENT DOCUMENTS

| | | | |
|---|---|---|---|
| 1,594,276 | 7/1926 | Stackhouse | 5/252 |
| 3,370,619 | 2/1968 | Docker . | |
| 3,462,274 | 6/1969 | Docker | 5/261 X |
| 3,472,290 | 10/1969 | Sykes et al. . | |
| 4,156,442 | 5/1979 | Sykes . | |

FOREIGN PATENT DOCUMENTS

| | | | |
|---|---|---|---|
| 733490 | 7/1955 | United Kingdom | 5/475 |
| 1104884 | 3/1968 | United Kingdom . | |
| 2143731 | 12/1986 | United Kingdom . | |

*Primary Examiner*—Michael F. Trettel

*Attorney, Agent, or Firm*—Wood, Herron & Evans

[57] ABSTRACT

A spring interior comprising a plurality of longitudinally extending bands of springs disposed side by side and connected together by helical lacing wires in the top and bottom faces of the bands. Each band of springs comprises a single length of wire formed into a plurality of substantially vertical coil springs interconnected by interconnecting segments of wire located alternately in the top and bottom faces of the bands. The coil springs of each row are interlaced with the adjacent coils of the same row. The spring interior is characterized by sections of differing firmness throughout the length of the spring interior. The sections of greatest firmness have such increased firmness imparted by a plurality of posture rods which extend through interlaced portions of a plurality of pairs of interlaced coils of the spring interior.

22 Claims, 3 Drawing Sheets

POSTURIZED SPRING BEDDING PRODUCT

This invention relates to spring interiors, and specifically to spring interiors for bedding products, such as mattresses and the like.

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British patent No. 1,104,884, will hereinafter be referred to as a band of interlocked or interlaced springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends lengthwise of the row.

When bands of interlocked springs of the type described hereinabove are assembled to form a spring interior, they are disposed side by side and interconnected by helical wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces portions of wires of the bands that extend transversely of the bands from the ends of the bridging portions of the links. In the top face of the spring interior the helical wires are disposed at uniform intervals along the bands of springs, the arrangement being such that there are two springs disposed in the interval between each helical wire and the next. There is a similar arrangement in the bottom face of the spring interior.

It will be appreciated from the foregoing description that the top face of a spring interior assembled in this way has the general appearance of a rectangular grid. Each of the transverse elements of the grid comprises a helical wire, and each of the longitudinal elements of the grid comprises a row of mutually aligned bridging portions. Within the confines of each rectangle of the grid and disposed a little lower than the grid are the upper end portions of two adjacent coil springs, those two springs constituting parts of the same band of springs. The bottom face of the spring interior is, of course, similar to the top face, though inverted.

In this description of the invention there are references to faces of bands of springs and of spring interiors. As the bands of springs and spring interiors are, of course, of open-work or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

It is customary for a bedding spring interior to be incorporated in an upholstered article. In such an article at least one of the main faces of the spring interior (that is the top and bottom faces thereof) is covered by a layer or layers of padding. This is turn is covered by a cover made of sheet material, such as ticking or upholstery fabric.

Pressure is applied unevenly to the top surface of a mattress when a person reclines atop the mattress. This uneven pressure or uneven loading of the mattress is a consequence of the uneven weight distribution of a person along the length of the body. The heaviest portion of the body is located approximately midway along the length of the body, and consequently, a person reclining atop a mattress tends to cause the mattress to deflect or sag to a greater extent in the lengthwise center of the mattress than at the ends. This uneven deflection in turn results in a person reclining atop the mattress having an unnatural and uncomfortable misalignment imparted to his or her spine.

To counter this uneven deflection of a mattress when a person is reclining atop the mattress, it has been proposed to reinforce or rigidify the lengthwise center section of the mattress. Such center section reinforcement or rigidification has taken the form of increasing the number or density of springs in the center section of the mattress, using different or firmer springs in the center section of the mattress, or adding additional structure to the center section to reinforce that section to a greater extent than the end sections. All of these center section reinforcement techniques, though, are relatively expensive and difficult to automate.

It has therefore been an objective of this invention to provide an improved method and apparatus for imparting differing firmness to differing lengthwise sections of a mattress.

Still another objective of this invention has been to provide an improved method and apparatus for increasing the firmness of selected lengthwise sections of a bedding spring interior of the interlocked spring type described hereinabove.

The invention of this application which achieves these objectives comprises a spring interior having a plurality of longitudinally extending bands of interlocked or interlaced coil springs wherein the bands are disposed side by side so that their top faces lie in a top main face of the spring interior and their bottom faces lie in a bottom main face of the spring interior. The bands of springs are interconnected by helical wires lying in the top and bottom faces of the bands and extending across the bands with each helical wire embracing portions of wires of the bands that extend transversely of the bands. In order to increase the firmness of coils in a selected section of the spring interior, as for example, the lengthwise, center one-third of the spring interior, posture rods extend transversely through overlapped portions of overlapped coils in multiple bands of the spring interior. These posture rods take the form of straight wire rods which extend through or are threaded through overlapped portions of multiple pairs of overlapped coils and are treated at the opposite ends so as to prevent the rods from inadvertently pulling out or being moved out from between the overlapped coils. The end treatment takes the form of either being bent into a loop at the end or being attached at the opposite ends to border rods of the spring interior.

The primary advantage of the invention of this application is that it enables selected sections or portions of spring interiors made from multiple bands of interlocked or interlaced coils to be inexpensively and easily increased in firmness relative to other sections of the spring interior. It also enables the edge of a selected portion of a spring interior to be increased in firmness by simply attaching the ends of multiple posture rods to the border rods or border wires of the spring interior.

These and other objects and advantages of this invention will become more readily apparent from the following description of the drawings in which.

Figure 1:
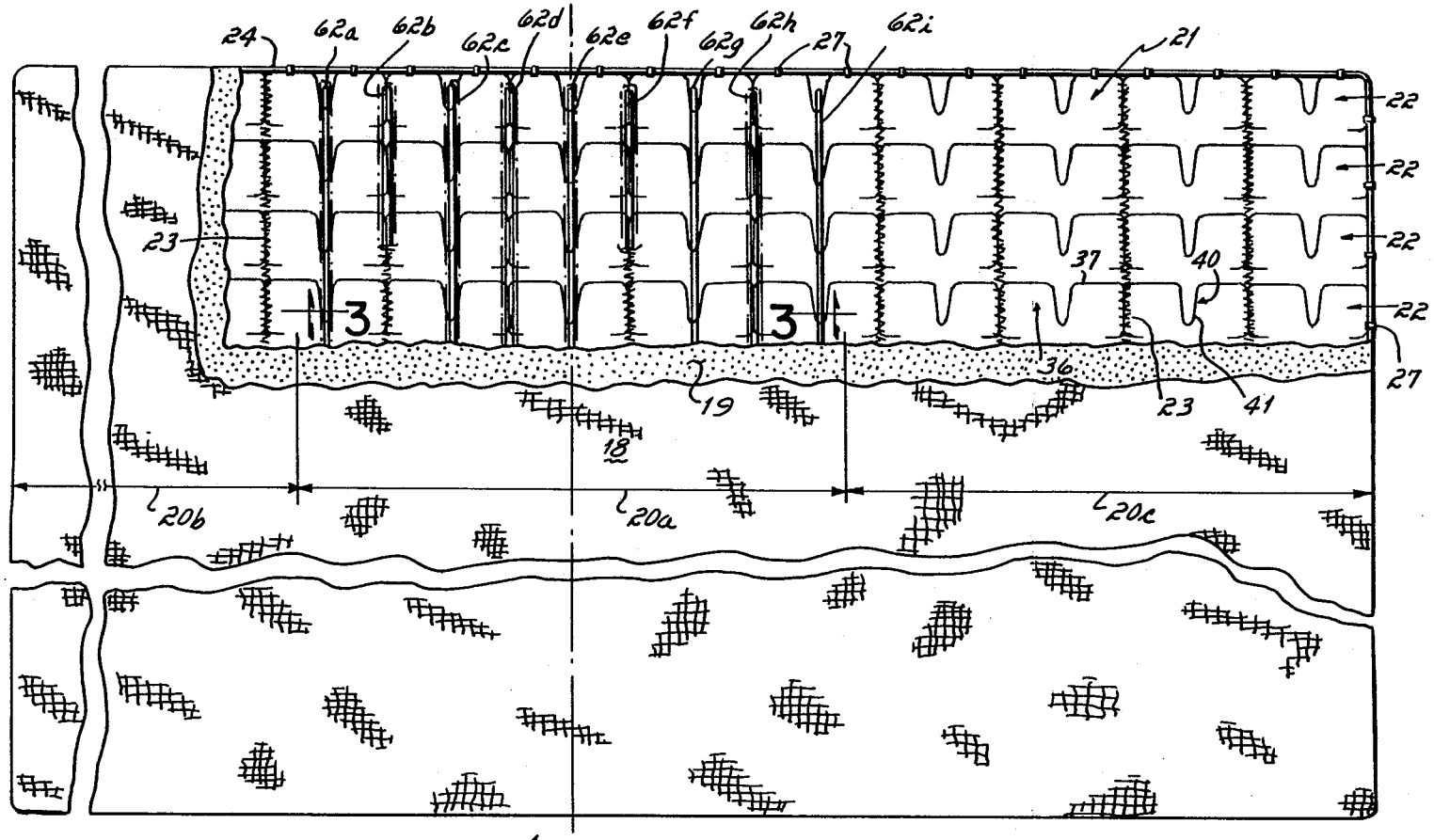
FIG. 1 is a top plan view, partially broken away, of a mattress incorporating the invention of this application.
Figure 2:
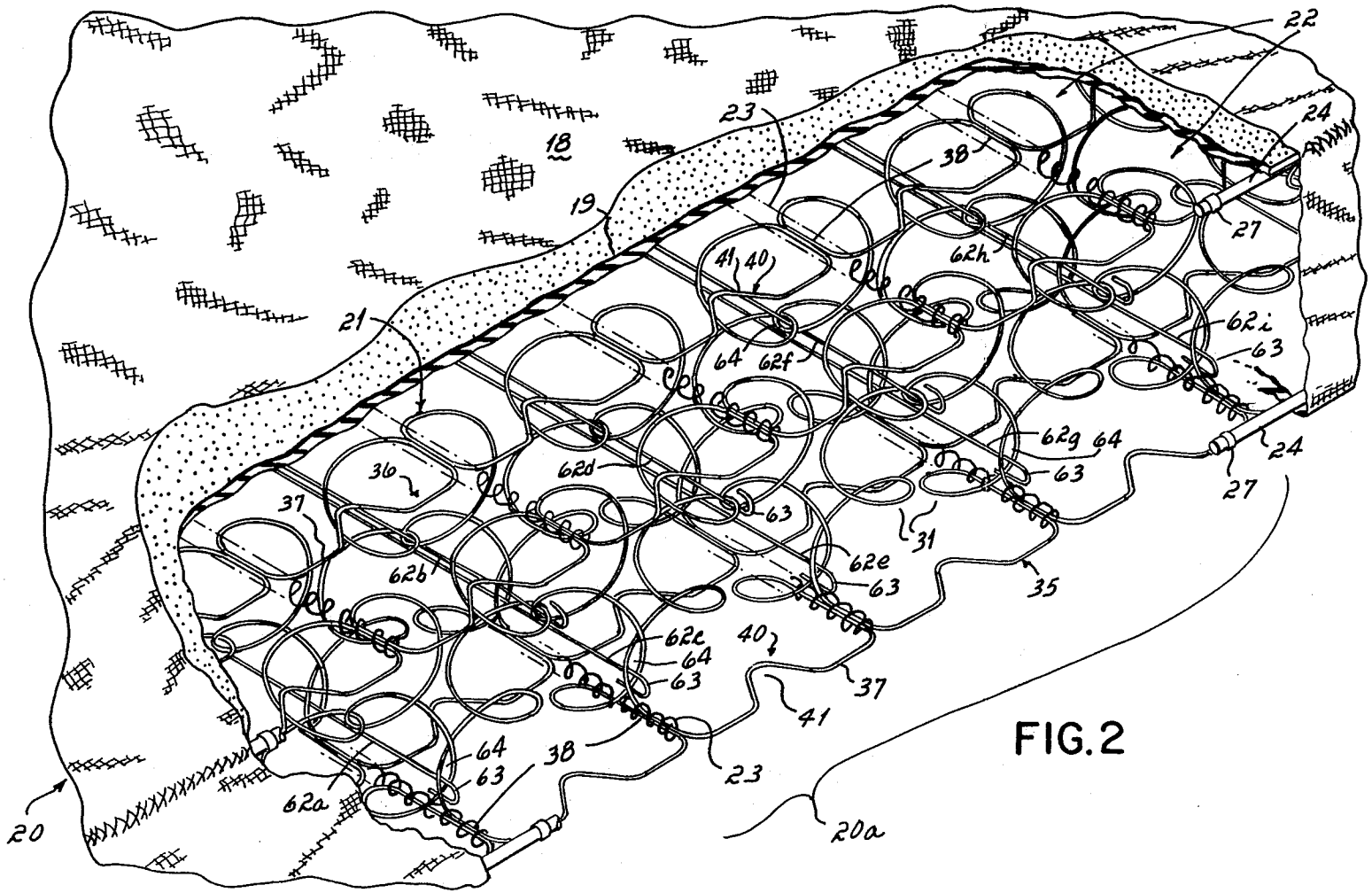
FIG. 2 is an enlarged perspective view, partially broken away, of a portion of two bands or rows of springs embodied in the mattress of FIG. 1.
Figure 3:
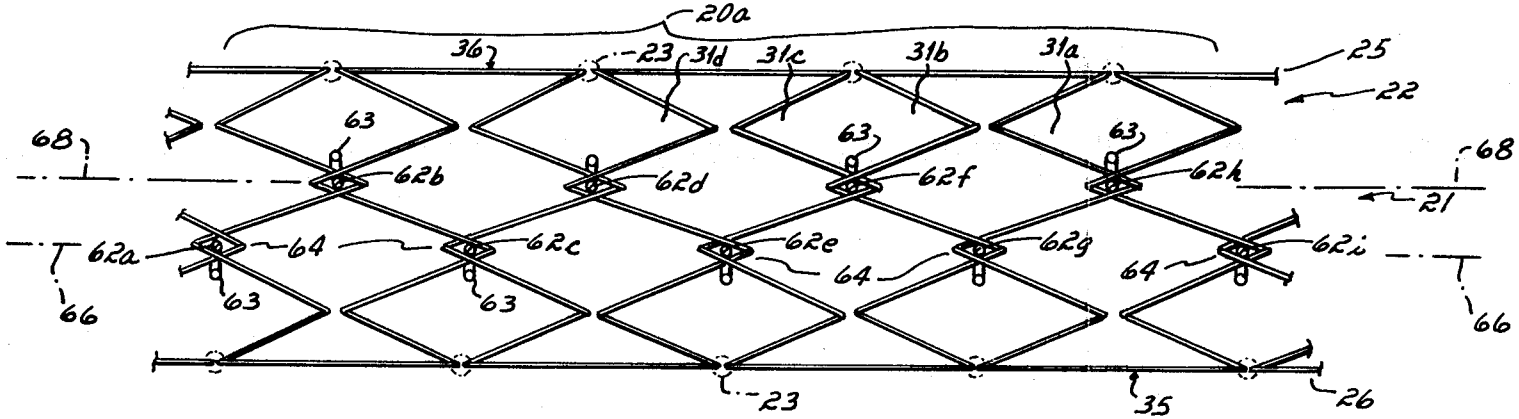
FIG. 3 is a cross-sectional view taken on line 3—3 of FIG. 1.

With reference first to FIGS. 1–3, there is illustrated a mattress 20 embodying the invention of this application. This mattress comprises a spring interior 21 on the top and bottom surfaces of which there is a pad 19. An upholstered covering 18 encases the spring interior 21 and the pads 19.

The spring interior 21 is formed from a plurality of bands of springs 22 which extend longitudinally, of the mattress. These bands of springs 22 are laced together by helical lacing wires 23 which extend transversely of the spring interior and secure the bands of springs in an assembled relation. A border wire 24 extends completely around the periphery of the spring interior in the top and bottom planes 25, 26, respectively, of the interior and is secured to the outermost edge of the spring interior in these planes by conventional sheet metal clips 27.

Each band of springs 22, a portion of one of which is illustrated in FIG. 3, is made from a single length of spring wire shaped to form a plurality of individual coil springs 31 arranged in a row. Each coil spring 31 comprises about two and one-half turns of wire. The axis of each coil spring is not upright but is inclined slightly lengthwise of the band, each spring being inclined in a direction opposite to that in which its two adjacent springs in the row are inclined. The end turns of the coil springs 31 lie adjacent to the top and bottom faces 25, 26 of the band. Each coil spring, such as that numbered **31*b* (FIG. 3), is so coiled as to have a hand opposite to the hand of the adjacent coil springs, such as 31*a* and 31*c*, immediately before and after it in the row. Each coil spring is joined to the next adjacent coil spring by two interconnecting segments 35, 36 (FIG. 2) of the wire integral with the coil springs. One of the two interconnecting segments 35, 36 is in the top face 25 of the band 22, and the other is in the bottom face 26 thereof. For example, coil spring 31*a* (FIG. 3) is connected to coil spring 31*b* by interconnecting segment 35, which is in the bottom face of the band, and the coil spring 31*b* is connected to coil spring 31*c* by interconnecting segment 36, which is in the top face of the band. Each interconnecting segment 35, 36 comprises a bridging portion 37, which extends longitudinally of the row of coil springs and end portions 38 which extend in a direction normal to the longitudinal axis of the band 22. Those end portions 38 of the interconnecting segments 35, 36 also lie in the top and bottom faces 25, 26 of the band 22**.

In the band 22 illustrated in FIGS. 1–4, the location of the intersection between each end 38 of each coil spring **31*a*, 31*b*, 31*c* or 31*d* and the associated end portion of the interconnecting segments 35, 36 is well defined, for the coil springs are curved and the end portions 38 of the interconnecting segments are straight. In other constructions, however, the intersections may be less well defined because the end portions 38 of the interconnecting segments 35, 36 may be replaced by arcuate extensions of the coil springs 31*a*, 31*b*, 31*c*; in those last cases the interconnecting segments must be considered as consisting solely of the bridging portions 37**.

Each bridging portion 37, in addition to extending longitudinally of the band, also extends laterally thereof to form a supporting structure 40. In the embodiment of FIGS. 1–4, the supporting structure 40 is in the form of a V-shaped indentation 41 of wire lying in the top 25 or bottom face 26 of the band 22, as the case may be, and extending to one side of the remainder of the bridging portion 37 of which it forms a part. Each V-shaped indentation 41 lies halfway between the end portions 38 of the interconnecting segment of which it forms a part, and it extends from one side face of the band toward the other side face thereof.

The method of manufacturing and the apparatus for manufacturing the band of springs illustrated in FIGS. 1–4 is completely described and illustrated in British patent No. 2,143,731. After the rows of coil springs are formed, each coil spring is interlaced with the next by having an intermediate turn thereof passed around an intermediate turn of the next spring. This coupling or interlacing can be carried out mechanically or manually.

A plurality of bands of springs 22 are assembled to form a spring interior 21. Bands of springs 22, each similar to that shown in FIGS. 1–4, are disposed side by side, and preformed helical wires 23 are attached to them. The helical wires 23 lie in the top and bottom faces 25, 26 of the bands and extend at right angles to the longitudinal axes of the bands. Each helical wire 23 embraces one pair of closely adjacent end portions 38 of each band.

It will be seen from FIG. 1 that much of the top and bottom faces of the spring interior have the general appearance of a rectangular grid. Each of the transverse elements of the grid comprises a helical wire 23, with the end portions 38 embraced by it, and each of the longitudinal elements of the grid comprises a row of mutually aligned bridging portions 37. Within the confines of each rectangle of the grid and disposed little lower than the grid are the upper end portions of two adjacent coil springs 31. Were it not for the presence of the supporting structure 40, the top face 25 and bottom face 26 of the spring interior 21 would present relatively large rectangular apertures into which upholstery material, such as filling or padding 60, placed on top of the top face could readily enter, thereby giving rise to "cupping." The presence of the supporting structures 40, however, reduces any tendency to "cupping," as the supporting structures occupy central parts of the rectangular apertures and can serve to support the upholstery material.

In accordance with the practice of the invention of this application, the lengthwise center one-third section 20*a* of the mattress 20 and spring interior 21 is posturized or increased in firmness relative to the endmost sections 20*b* and 20*c*. "Posturization" is a term of art used to describe the increasing of the firmness of one section of a mattress or spring product relative to another section. In this instance, the posturization is the practice of increasing the firmness of the lengthwise, centermost one-third section of the mattress. This is the section which supports the greatest concentration of weight of a person reclining atop the mattress and is therefore the section most subject to sagging or drooping relative to the other endmost sections. To prevent that sagging or drooping which can cause discomfort of a person reclining atop the mattress because of the sag or unnatural curvature of the spine which occurs in the most heavily loaded, centermost section of the mattress, this section is the one which is commonly increased in firmness.

To increase the firmness of this centermost section 20*a* of the mattress and spring interior 21, the spring interior 21 includes nine posturizing rods 62*a*–62*i* which extend transversely between opposite sides of the spring interior and pass through or between overlapped portions 64 of overlapped intermediate turns of coil springs 31. These rods 62*a*–62*i* are straight rods, except for the endmost portions which, as explained more fully hereinafter, have end treatments to prevent the rods from pulling out of or being withdrawn from between the overlapped portions 64 of the coils 31.

The rods 62*a*–62*i* are all identical and are, in the preferred embodiment, of slightly heavier gauge or diameter than the wire from which the bands 22 of coil springs are formed, but are of less gauge or diameter than the border wires 24 which surround the spring interior in the top and bottom planes or faces 25, 26 of the spring interior. These rods 62, though, may be of greater or lesser diameter relative to the diameter of the wire bands 22, depending upon the firmness desired to be imparted to the spring interior 21 by the rods.

As explained hereinabove, the adjacent coils of each band of coils 22 are interlaced or interwoven to the extent of having one intermediate turn of each coil interwoven with one intermediate turn or revolution of each adjacent coil. That is, and with reference to FIG. 4, the coil 31*b* has one turn or revolution interlaced or interwoven with the adjacent coil 31*a* and another turn or revolution interwoven or interlaced with one turn of the adjacent coil 31*c*. Thus, each coil 31, except for the endmost coils of a band of springs 22, has two turns or revolutions interlaced with turns or revolutions of the two adjacent coils, and the endmost coil 31 has one turn or revolution interlaced with one turn or revolution of the adjacent coil of the same band 22 of coil springs. These overlapping portions 64 of the coil springs 31 provide a passageway therebetween through which the straight posture rods 62 are threaded or inserted. The overlapping portions 64 of the coils of adjacent bands are colinearly aligned and provide aligned columns of overlapping portions 64 through which the posture rods 62 may be, and, in fact, are, inserted or threaded.

With reference to FIG. 3, it will be seen that in the preferred embodiment, there are nine posture rods in the centermost one-third section 20*a* of the spring interior 21. Five of these posture rods are located in a lower horizontal plane 66 which extends horizontally parallel to the top and bottom faces 25 and 26 of the spring interior 21, and the four other posture rods 62 are contained in an upper horizontal plane 68 which is spaced from, but parallel to, the plane 66.

With reference to FIG. 2, it will be seen that the endmost portions of each posture rod 62 are bent into a hook-shaped end 63 so as to prevent the posture rods from moving laterally and pulling out or being pulled out of from between the overlapped portions 64 of adjacent coils. The endmost portions 63 of the posture rods 62 may be formed into a J-shaped hook or into a loop or any other configuration which prevents the rods from being pulled through or being unthreaded from the passageway between overlapped portions 64 of adjacent coils.

Figure 4:
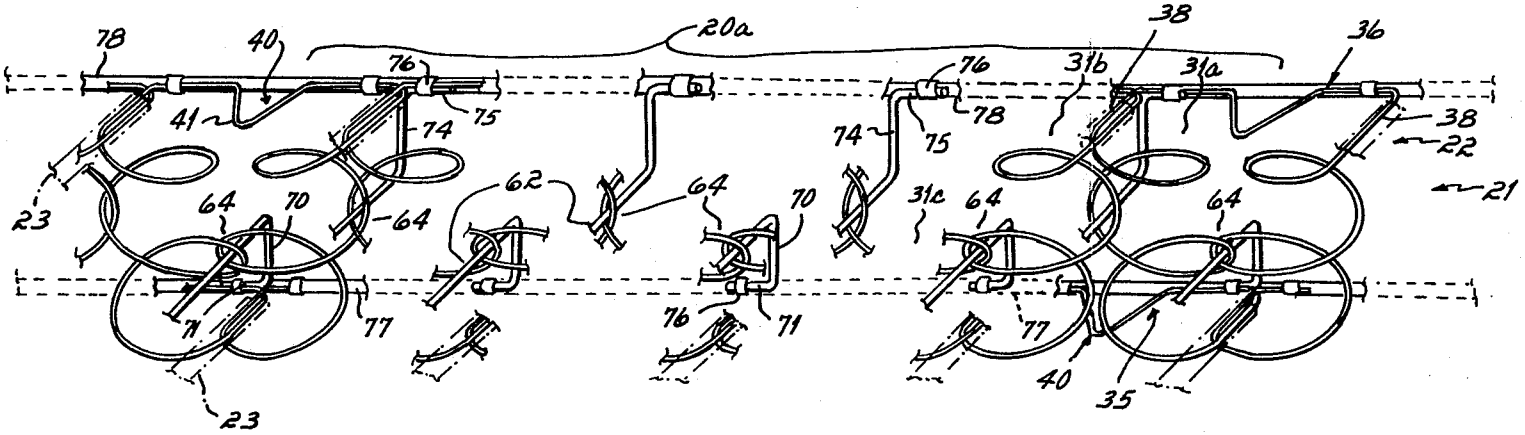
FIG. 4 is a perspective view of a portion of a spring interior incorporating a modified version of the posture rods of the spring interior of FIG. 1.

With reference now to FIG. 4, it will be seen that in lieu of a J-shaped hook 63 being formed on each end of each posture rod 62, those posture rods 62 which are located in the lower plane 66 are formed into a downwardly extending end section 70 and a longitudinally extending endmost section 71. Similarly, the ends of those posture rods 62 located in the upper plane 68 have an upwardly extending end section 74 and an endmost longitudinally extending section 75. The endmost sections 71 and 75 of the posture rods are secured by conventional metal clips 76 to the bottom and top border wires 77 and 78, respectively.

The presence of the posture rods 62 in the spring interior 21 functions to increase the firmness of the coil springs and thus, of the spring interior, in that section 20*a* of the mattress or spring interior within which the posture rods are located. By increasing the firmness of the spring interior in this section, the mattress or spring interior is better able to conform the top surface of the mattress or spring interior to the spinal configuration of a person reclining atop the mattress and to prevent misalignment of that person's spine as a consequence of the centermost and most heavily loaded section of the mattress deflecting to such an extent as to cause misalignment of the person's spine while that person reclines atop the mattress.

While in the preferred embodiment, the spring interior 21 has been described as containing nine posture rods, it could, of course, contain greater or lesser numbers of posture rods, depending upon the length of the section to be increased in firmness. With a greater number of posture rods, the length of the increased firmness section 20*a* could be increased and with a lesser number, the length of the posturized section could be decreased. Alternatively, the rods could be placed in only the overlapped portions 64 of the interlaced coils contained in the uppermost plane 68 so as to increase the firmness of that side, while leaving the other side of the mattress relatively less firm because of the absence of posturized rods in the lower plane 66 of the overlapped portions of the interlaced coils of the spring interior.

While I have described only two embodiments in my invention, persons skilled in the art to which it applies will appreciate changes and modifications which may be made without departing from the spirit of my invention. Therefore, I do not intend to be limited except by the scope of the following appended claims:

I claim:

1. A bedding mattress comprising a spring interior having a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending transversely across the bands, each helical wire embracing portions of wires of the bands that extend transversely of the bands from the ends of said bridging portions thereof, there being, in each face of the spring interior, two springs in the interval between each helical wire and the next, padding overlying at least one of said main faces of said spring interior, an upholstered covering material encasing said spring interior and said padding, and the spring interior being characterized by varying firmness of the coil springs throughout the length of the spring interior, said varying firmness being the result of posture rods extending transversely through interlaced portions of selected interlaced coils of the spring interior, each posture rod being located between said top main face and bottom main face of said spring interior.

2. A spring interior comprising a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending transversely across the bands, each helical wire embracing portions of wires of the bands that extend transversely of the bands from the ends of said bridging portions thereof, there being, in each face of the spring interior, two springs in the interval between each helical wire and the next, and the spring interior being characterized by differing firmness of the coil springs throughout the length of the spring interior, said differing firmness being the result of posture rods extending transversely through a plurality of interlaced portions of interlaced coils of the spring interior, each posture rod being located between said top main face and bottom main face of said spring interior.

3. A spring interior comprising a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending transversely across the bands, and the spring interior being characterized by differing firmness of the coil springs throughout the length of the spring interior, said differing firmness being the result of posture rods extending transversely through interlaced portions of a plurality of interlaced coils of the spring interior, each posture rod being located between said top main face and bottom main face of said spring interior.

4. A spring interior according to claim 3 characterized in that each posture rod is substantially straight and extends transversely through interlaced portions of multiple pairs of interlaced coils.

5. A spring interior according to claim 4 characterized in that each posture rod extends from a pair of interlaced coils on one transverse side of said spring interior and a second pair of interlaced coils on the opposite transverse side of said spring interior.

6. A spring interior according to claim 5 characterized in that each posture rod has a loop formed at the opposite ends thereof to prevent the posture rod from inadvertently pulling out of from between said interlaced coils.

7. A spring interior according to claim 5 characterized in that a first border rod extends around the periphery of said spring interior in said top main face and a second border rod extends around said bottom main face of said spring interior, and each posture rod being secured at its opposite ends to said border rods.

8. The spring interior according to claim 7 wherein the opposite ends of each posture rod are secured to the same border rod.

9. A spring interior comprising a plurality of longitudinally extending bands of springs disposed side by side and connected together in the top and bottom faces of the bands, each of said bands of springs comprising a single length of wire formed into a plurality of substantially vertical coil springs arranged in a row and interconnected by interconnecting segments of wire located alternately in the top and bottom faces of the bands, each of said interconnecting segments comprising a longitudinally extending bridging portion, each of the coil springs being interlaced with the adjacent coil springs of the same row, and the spring interior being characterized by differing firmness of the coil springs throughout the length of the spring interior, said differing firmness being the result of posture rods extending through interlaced portions of a plurality of pairs of interlaced coils of the spring interior, each posture rod being located between said top and bottom faces of the bands.

10. A spring interior according to claim 9 characterized in that each posture rod is substantially straight and extends transversely through interlaced portions of multiple pairs of interlaced coils.

11. A spring interior according to claim 9 characterized in that each posture rod extends from a pair of interlaced coils on one transverse side of said spring interior and a second pair of interlaced coils on the opposite transverse side of said spring interior.

12. A spring interior according to claim 9 characterized in that each posture rod has a loop formed at the opposite ends thereof to prevent the posture rod from inadvertently pulling out of from between said interlaced coils.

13. A spring interior according to claim 9 characterized in that a first border rod extends around the periphery of said spring interior in said top main face and a second border rod extends around said bottom main face of said spring interior, and each posture rod being secured at its opposite ends to said border rods.

14. The spring interior according to claim 13 wherein the opposite ends of each posture rod are secured to the same border rod.

15. A method of increasing the firmness of at least one selected lengthwise section of a spring interior comprising a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to the adjacent coil springs by interconnecting segments integral with the coil springs, one of the interconnecting segments being located substantially in the top face of the band and the other of the interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending transversely across the bands, each helical wires embracing portions of wires of the bands that extend transversely of the bands from the ends of said bridging portions thereof, there being, in each face of the spring interior, two springs in the interval between each helical wire and the next, which method comprises inserting posture rods transversely through a plurality of interlaced portions of pairs of interlaced coils of the spring interior, said posture rods being inserted through said interlaced portions of pairs of interlaced coils at locations between said top main face and bottom main face of said spring interior.

16. A method of increasing the firmness of at least one selected lengthwise section of a spring interior comprising a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending transversely across the bands, which method comprises inserting a plurality of posture rods transversely through interlaced portions of a plurality of pairs of interlaced coils of the spring interior, said posture rods being inserted through said interlaced portions of pairs of interlaced coils at locations between said top main face and bottom main face of said spring interior.

17. A method of increasing the firmness of at least one selected section of a spring interior comprising a plurality of longitudinally extending bands of springs disposed side by side and connected together in the top and bottom faces of the bands, each of said bands of springs comprising a single length of wire formed into a plurality of substantially vertical coil springs arranged in a row and interconnected by interconnecting segments of wire located alternately in the top and bottom faces of the bands, each of said interconnecting segments comprising a longitudinally extending bridging portion, each of the coil springs being interlaced with the adjacent coil springs of the same row, which method comprises inserting posture rods through interlaced portions of a plurality of pairs of interlaced coils of the spring interior, each of said posture rods being inserted through interlaced portions of said pairs of interlaced coils at locations between said top and bottom faces of said bands.

18. The method of claim 17 wherein each posture rod is substantially straight and extends transversely through interlaced portions of multiple pairs of interlaced coils.

19. The method of claim 18 wherein each posture rod is inserted through a pair of interlaced coils on one transverse side of said spring interior and a second pair of interlaced coils on the opposite transverse side of said spring interior.

20. The method of claim 19 wherein each posture rod receives an end treatment on the opposite ends of the rod, such end treatment being operable to prevent the posture rods from inadvertently pulling out of from between said interlaced coils.

21. The method of claim 20 wherein such end treatment comprises forming an end loop in each end of each of said posture rods.

22. The method of claim 18 wherein said spring interior has a first border rod extending around the periphery of said spring interior in said top main face and a second border rod extending around said bottom main face of said spring interior, and said method further comprising securing the opposite ends of each posture rod to said border rods.

* * * * *